US007255422B2

(12) United States Patent
Haug

(10) Patent No.: US 7,255,422 B2
(45) Date of Patent: Aug. 14, 2007

(54) FRANKING MACHINE

(75) Inventor: Werner Haug, Langnau im Emmental (CH)

(73) Assignee: Frama AG, Lauperswil (CH)

( * ) Notice: Subject to any disclaimer, the term of this patent is extended or adjusted under 35 U.S.C. 154(b) by 1489 days.

(21) Appl. No.: 10/009,682

(22) PCT Filed: Feb. 22, 2001

(86) PCT No.: PCT/CH01/00121

§ 371 (c)(1),
(2), (4) Date: Dec. 30, 2001

(87) PCT Pub. No.: WO01/62506

PCT Pub. Date: Aug. 30, 2001

(65) Prior Publication Data

US 2003/0016981 A1 Jan. 23, 2003

(51) Int. Cl.
*B41J 2/21* (2006.01)

(52) U.S. Cl. ..... 347/40; 705/406; 101/91

(58) Field of Classification Search ..... 347/40, 347/43, 104; 101/91, 92; 705/406; 400/630
See application file for complete search history.

(56) References Cited

U.S. PATENT DOCUMENTS 4,821,049 A 4/1989 Eckl
5,166,883 A 11/1992 Gilham
5,440,979 A 8/1995 Bonham et al.
5,806,994 A 9/1998 Coffy et al.
5,913,627 A 6/1999 Freeman et al.
6,048,048 A * 4/2000 Gregoire ..... 347/40
6,390,577 B1 * 5/2002 Fajour ..... 347/2
6,895,395 B1 * 5/2005 Blanluet et al. ..... 705/408

FOREIGN PATENT DOCUMENTS

EP 0961235 12/1999

* cited by examiner

*Primary Examiner*—Lamson D. Nguyen
(74) *Attorney, Agent, or Firm*—Friedrich Kueffner

(57) ABSTRACT

The invention relates to a franking machine comprising an inkjet printing unit with two printing heads (301A, 301B), for printing on flat posted objects which can be inserted or run through the unit, such as letters or postcards. Said machine further comprises a guide piece (317), arranged around the print heads (301A, 301B) and projecting relative to the common jet opening plane thereof. A transport device for the posted objects is connected to said guide piece, with two drive rollers which, together with the guide piece, form a transport path and which are mounted before and after the print head, relative to the transport direction. The printing heads (301A, 301B) form a common jet opening plane and on the jet opening plane are rectangular in form, arranged at a steep angle to the direction of travel of the posted objects and mutually offset from each other.

6 Claims, 5 Drawing Sheets

FRANKING MACHINE

Figure 1:
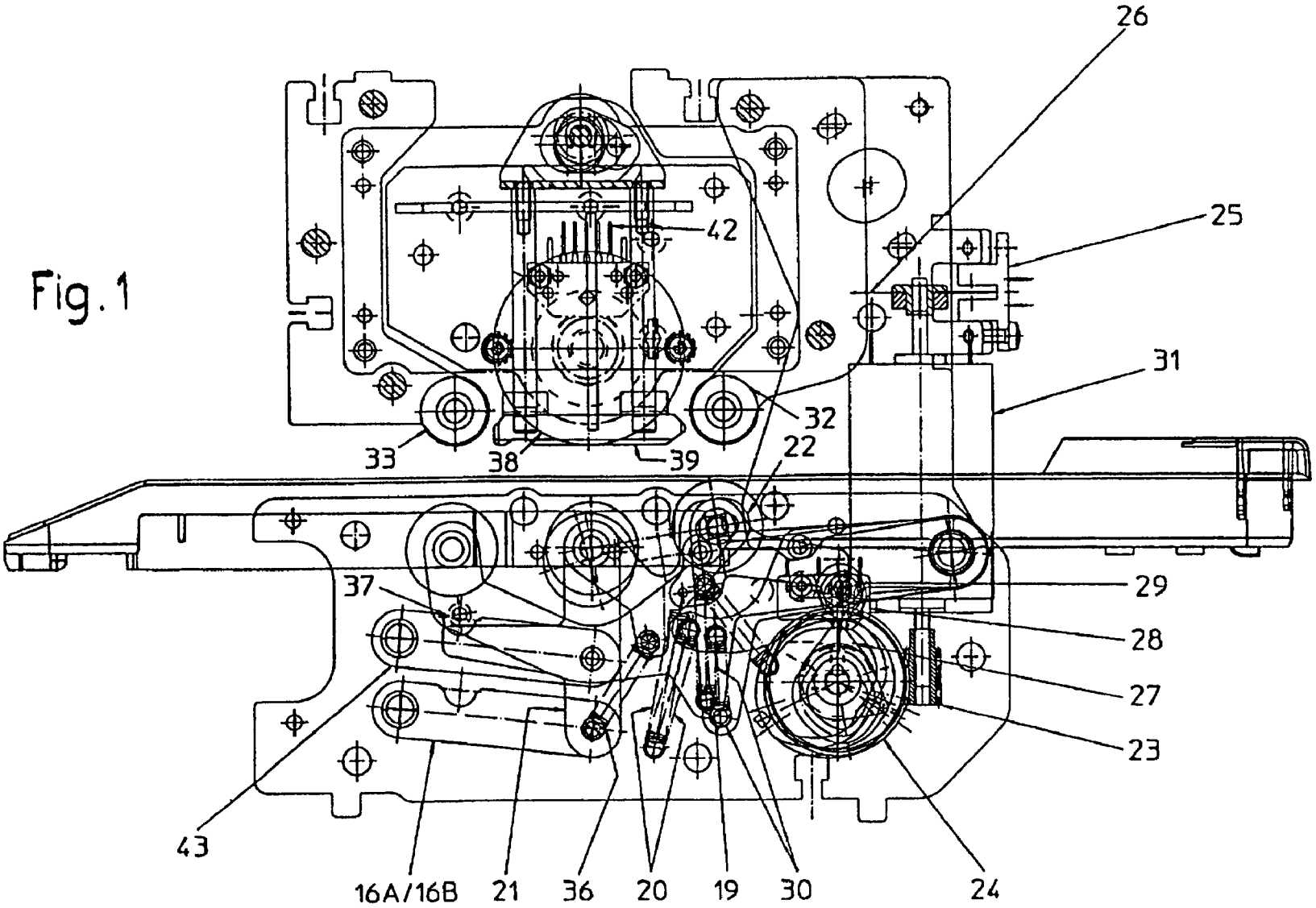

The invention relates to a franking machine with an inkjet printing mechanism having at least one print head for printing flat postal objects, such as letters or postcards, inserted into or passing through the machine, comprised of a guide part arranged so as to project from the print head and relative to its jet opening plane and having correlated therewith a transport device for transporting the postal objects between it and oppositely positioned conveying rollers rotating about axes oriented transverse to the conveying direction, wherein the transport device comprises two drive rollers forming together with the guide part a conveying path, which drive rollers, when viewed in the conveying direction, are supported before and behind the print head, and counterpressure rollers arranged opposite thereto are provided, which exert a pressure against the drive roller or the postal object to be transported therebetween.

Franking machines employ today in addition to the classical rotary printing technology increasingly new stamp application methods, inter alia, based on thermal or inkjet basis.

Inkjet print heads have been known for quite some time and are used, in particular, in PC printers. The knowledge that has been gained for use of such print heads in this field cannot be transferred onto the present field of use in franking machines. The reasons, inter alia, lie in the high speed of the letters undergoing franking as well as their different formats and thicknesses as well as the considerably rougher conditions of the surroundings, caused partially by soiled surfaces of the postal objects. Moreover, these franking prints must fulfill strict quality requirements of the postal offices, which make necessary high construction expenditure and reliability.

The object of the present invention resides in providing a franking machine with an inkjet print mechanism that enables a disruption-free printing for the franking of postal objects, such as letters, cards or the like, and an unequivocally identifiable print image. Moreover, conditions are to be provided that ensure a high reliability and low-maintenance configuration.

According to the invention this object is solved in that the printing mechanism has at least two print heads which have a common jet opening plane, in that the print heads, viewed onto the jet opening plane, are rectangularly shaped, respectively, and positioned at an acute angle to the conveying direction of the postal objects and positioned partially staggered relative to one another.

In the following, the functions and the configuration of an embodiment of the franking machine according to the invention is described. For a better understanding, reference is being had to the reference numerals and Figures in which embodiments of the invention are illustrated.

| | |
|---|---|
| 1A | forward control curve for right counterpressure roller |
| 1B | rear control curve for right counterpressure roller |
| 2A | forward control curve for left counterpressure roller |
| 2B | rear control curve for left counterpressure roller |
| 3 | main shaft |
| 4 | rear sidewall |
| 5 | forward sidewall |
| 6A | counterpressure lever, left, front |
| 6B | counterpressure lever, left, rear |
| 7A | control lever, left, front |
| 7B | control lever, left, rear |
| 8A | counterpressure lever, right, front |

-continued

| | |
|---|---|
| 8B | counterpressure lever, right, rear |
| 9A | control lever, right, front |
| 9B | control lever, right, rear |
| 10 | axle for counterpressure lever and control lever |
| 11 | stop bolt for counterpressure lever - right |
| 12 | stop bolt for counterpressure lever - left |
| 13 | counterpressure roller - right |
| 14 | support roller |
| 15 | counterpressure roller - left |
| 16A | linkage, front, for support roller |
| 16B | linkage, rear, for support roller |
| 17 | axle for linkage |
| 18 | rod for suspending spring |
| 19 | suspension location for spring |
| 20 | tension spring for control lever |
| 21 | support roller carrier with sensor member |
| 22 | cam follower |
| 23 | worm shaft |
| 24 | worm gear |
| 25 | forked light barrier |
| 26 | slotted disk |
| 27 | switching cam for initial position of main shaft |
| 28 | microswitch |
| 29 | control roller |
| 30 | tension spring for counterpressure lever |
| 31 | direct-current motor |
| 32 | drive roller, right |
| 33 | drive roller, left |
| 34 | axle for counterpressure roller, right |
| 35 | stop for cam follower |
| 36 | tension spring for cam follower |
| 37 | stop for sensor member |
| 38 | sensor wheel for incremental transponder |
| 39 | holding-down plate or guide part |
| 40 | drive motor for feed |
| 41 | gearbox for drive rollers |
| 42 | incremental transponder, encoder |
| 43 | projecting member on support roller carrier |

DESCRIPTION OF THE DRAWINGS CONTENTS OF THE FOLLOWING FIGURES

Figure 2:
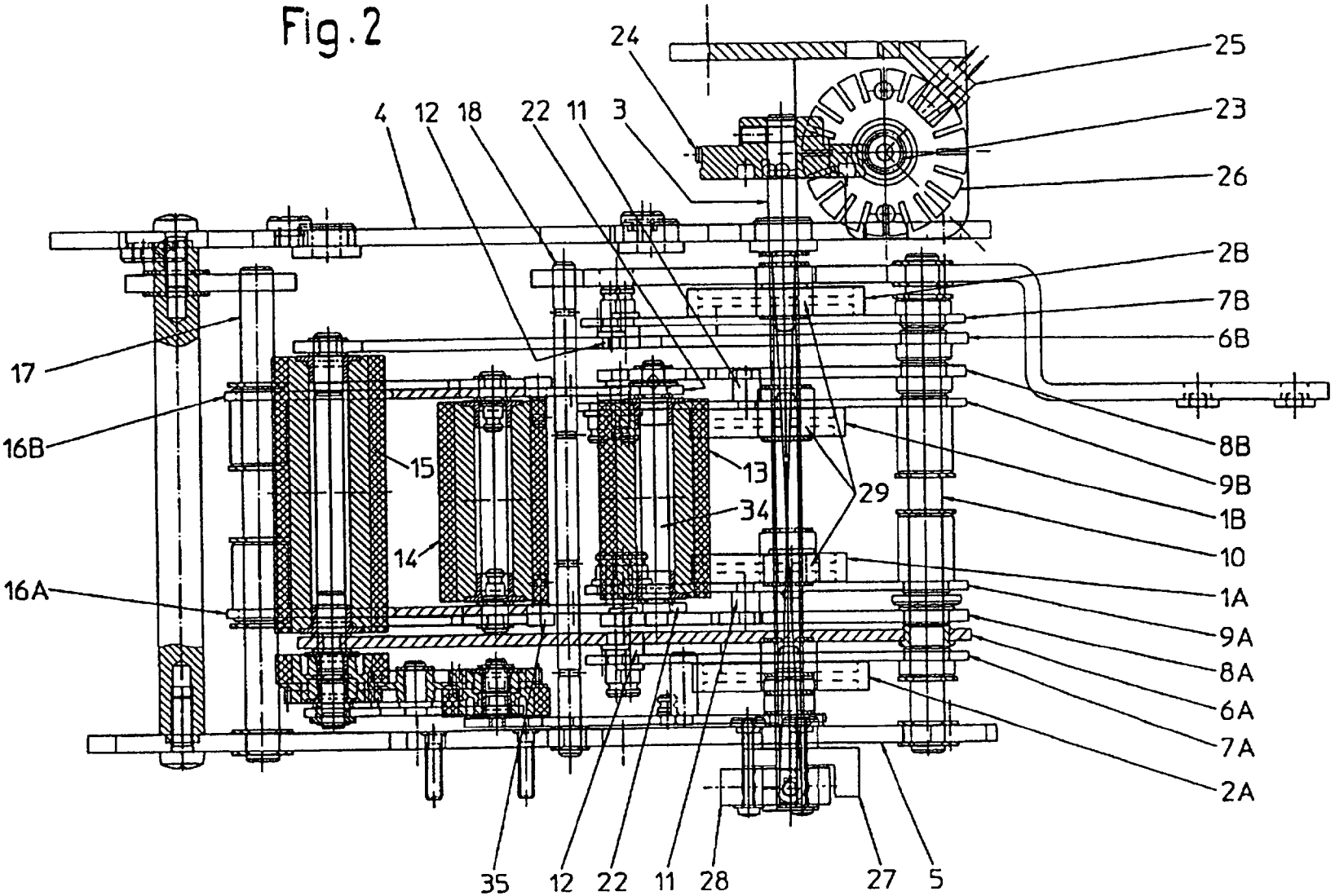

FIG. 1 front view of the complete counterpressure mechanism, including drive, sensor wheel, and main shaft drive;

FIG. 2 plan view onto counterpressure mechanism.

In the case of franking of individual letters, the letter is inserted manually into the franking machine. Photo cells start the franking process when the envelope is correctly positioned. The counterpressure rollers which are in a lower position upon insertion of the envelope are moved upwardly by the control curves on the main shaft and press the letter object against the upper drive rollers. The letter transport or the franking process is started.

The counterpressure arrangement is comprised of counterpressure rollers. Two rollers are positioned under the right and left drive rollers. A third, central roller has the object to move the letter to the required height level under the print heads without pressing the letter against the end faces of the print heads so that the print image remains clean without smearing. After the franking process, the counterpressure rollers move again downwardly and release the gap for the insertion of a new envelope.

Description of FIGS. 1 and 2

The counterpressure levers are in the initial position ready for insertion of an individual letter. As soon as the letter is positioned in an exact position to the rear and the right defined by the table stop, the franking machine is activated by means of a reflective light barrier. First the main shaft 3 rotates about approximately one-third revolution in the clockwise direction. The control levers 7, 9 are pivoted upwardly by the control rollers 29 by means of the control curves 1, 2. The counterpressure levers are also moved upwardly via the tension springs 30 until the counterpressure rollers 13, 15 rest against the drive rollers 32, 33. The control levers move still farther until the control curve has reached its highest point. The possible overstroke of the control lever is compensated by the sprung coupling of the counterpressure levers. The support roller 14 has been adjusted by means of the cam follower 22 to the same level. The letter is now clamped between the drive rollers and the counterpressure rollers. The drive motor 40 drives via the gear mechanism 41 the drive rollers 31, 33 and moves the letter from the right to the left. The speed and position detection is realized by the incremental transponder 42 and the sensing wheel 38. The sensing wheel is driven by friction by means of the moving envelope and detects thus the precise speed of the letter surface. As a function of the letter position, the inkjet print heads spray corresponding line patterns which result in the desired print image. The holding-down plate or the guide part 39 secures the letter at an exact spacing to the print head end face in order to enable with respect to resolution a clean print image and, furthermore, to prevent that the printed lines smear when moving the envelope. After completion of the franking process the drive motor is switched off and the main shaft returns by rotation into its initial position; the counterpressure levers reach again their initial position.

The inkjet print heads are attached to an adjusting module. By means of this mechanical device the print heads can be precisely adjusted relative to one another so that the initial pixel of one head coincides precisely with the final pixel of the second head and in this way no print image gaps result. The print heads are connected by means of hoses to an ink bag container which can be easily exchanged. For the first operation, the ink must be removed by vacuum from the ink bag and the print heads must be flooded.

Numbering and Parts Identification List for Print Head Adjusting Module

| | |
|---|---|
| 301A | forward inkjet print head |
| 301B | rearward inkjet print head |
| 302 | washer |
| 303 | clamping sheet for print head |
| 304 | adjustable print head support plate |
| 305 | rigid print head support plate |
| 306 | adjusting screw |
| 307 | spring washer for adjusting stroke |
| 308 | spring washer for pressing |
| 309 | collar screw |
| 310 | clamping screw |
| 311 | press-in threaded bushing |
| 312 | projections for the print head positioning |
| 313 | head plate |
| 314 | support plate |
| 315 | column guide bushing |
| 316 | lifting column |
| 317 | holding-down plate or guide part |
| 318 | pressure spring |
| 319 | lifting plate |
| 320 | lifting eccentric |
| 321 | locking screw |
| 322 | press-in threaded bushing |
| 323 | spacer sleeve |

Description of Contents of Drawings for the Following Figures

Figure 3:
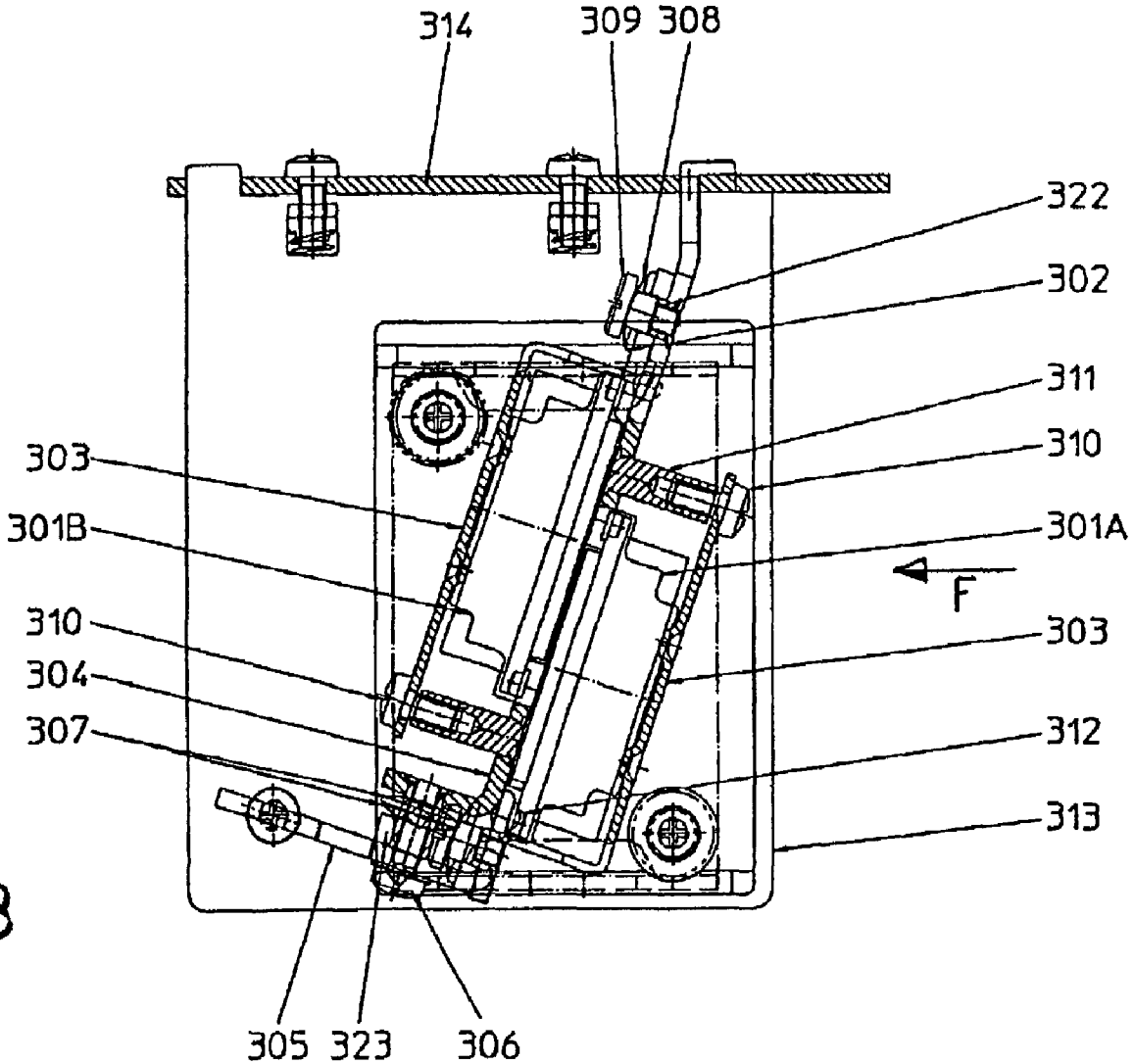
Figure 4:
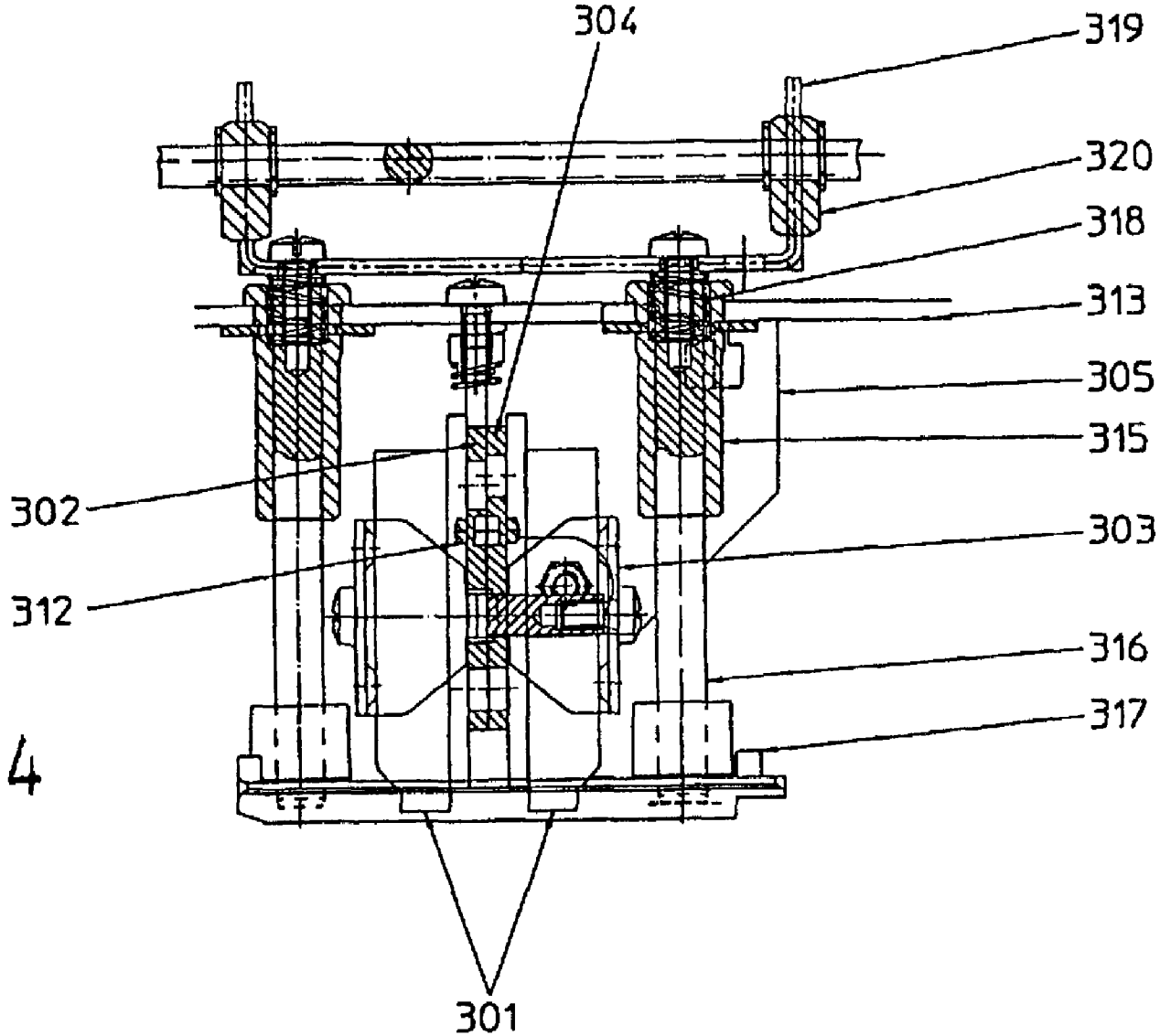
Figure 5:
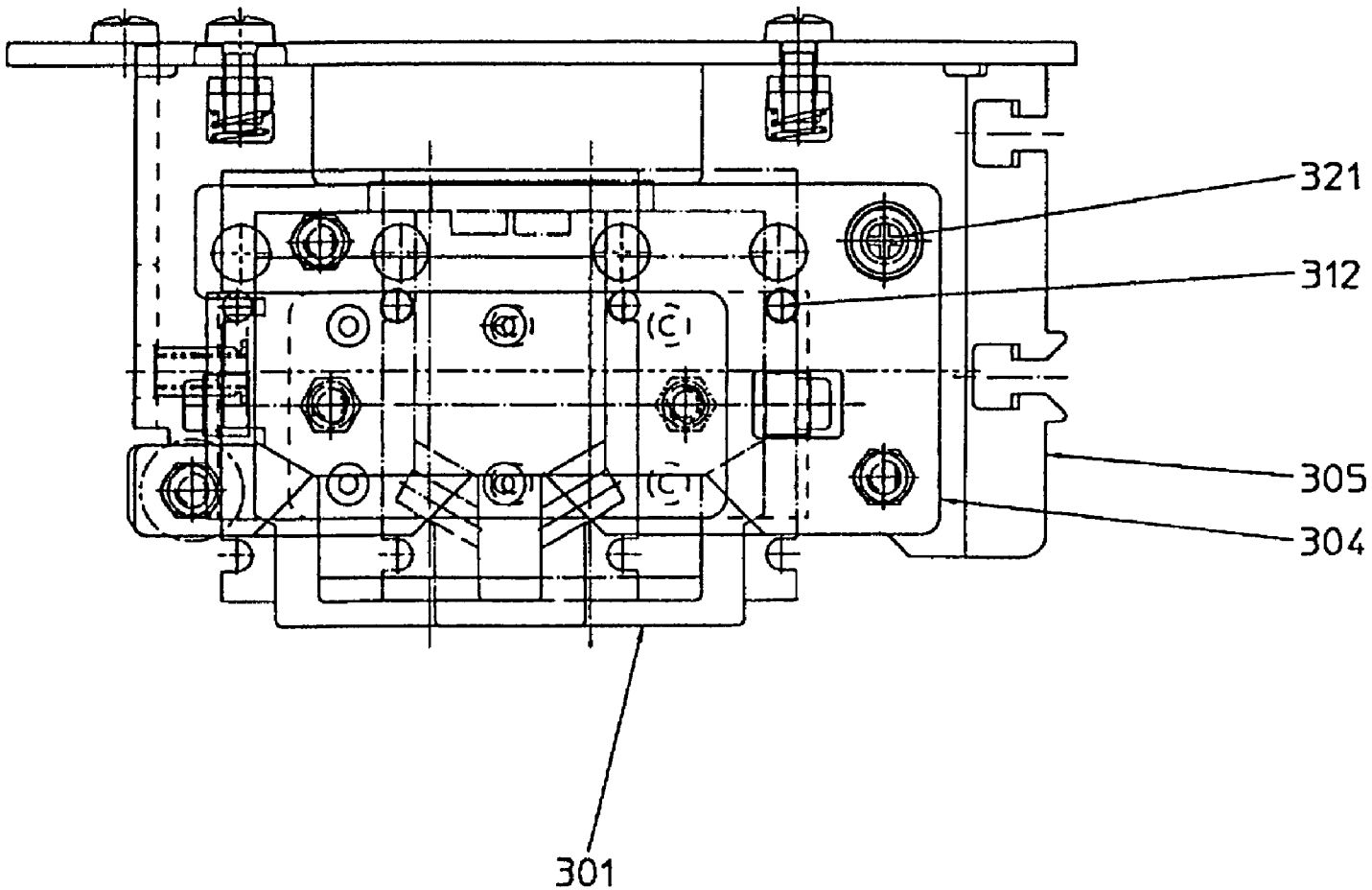

FIG. 3 plan view onto the print head adjusting module;

FIG. 4 front view of the print heads and the print head support plates; in this view, not all parts are illustrated in their actual position; and FIG. 5 front view of the print heads and the print head support plates.

In the franking machine described herein, two inkjet print heads are required for the realization of the required print image height and the resolution. For achieving the print image height, the print heads are displaced to one another in the direction of depth, i.e., the upper half of the print image is generated by the rearward print head and the lower half by the front print head. In order to prevent gaps or overlapping printing in the print image, the pixel lines of the two print heads must be adjusted relative to one another. Moreover, the print heads are arranged, in a plan view, at a slant to one another because with this slanted position the effective spacing of the individual print jets is smaller and, in this way, a higher resolution of the print image is made possible. The print head is rigidly mounted while the second print head is movable or fine-adjustable along the jet row relative to the rigid print head. The holding-down plate or guide part described already is also supported on the print head adjusting module.

The print head unit is a separate or individual module, i.e., mounting as a complete subunit is possible and the print heads can be fine-adjusted before completing assembly. On the support plate 314 the rigid print head support plate 305 and the head plate 313 are mounted. The forward print head 301A is precisely positioned by means of the projections 312 and pressed against the print head support plate 305 by small embossments on the clamping sheet 303. Clamping is realized by the clamping screw 310 and the pressing nut 311. On the backside of the rigid print head support the adjustable print head support plate 304 is located. It is slidable with regard to depth and is guided by the press-in threaded bushings 322 and the collar screws 309. The collar screws 309 press the adjustable print head support plate 304 by means of the spring discs 308 and the washers 302 against the contact surface. The adjustable print head support plate can be moved against friction of this pressing force. The rearward print head 301B is positioned and secured like the front one. The adjustable print head support plate 304 has at its forward side a bent portion into which a threaded bushing is pressed. Onto this threaded bushing, a spring washer package 307 and the spacer sleeve 323 are mounted. The spring package is clamped between the bent angle pieces of the rigid and adjustable print head support plates. The adjustment of the adjustable print head support plate is realized by the adjusting screw 306. Upon tightening the adjusting screw the rearward print head together with the print head support plate will move forwardly. Upon release the unit moves under the spring force of the spring package 307 to the rear. As a result of the pretension of the spring package any play is eliminated. The reward print head 301B is adjusted such that the frontmost inkjet nozzle coincide with the rearmost one of the forward print head or has exactly a spacing of one pixel. After adjusting precisely the print heads, the adjustable part is secured by means of the locking screw 321 so that it can no longer be moved. In the head plate 313 two column guide bushings 315 are also seated which guide the columns 316 of the holding-down plate or guide part 317. The holding-down plate or guide part 317 is moved up and down by means of a lifting eccentric 320. The pressure spring 318 lifts the lifting plate 319 upwardly without play.

The invention claimed is:

1. Franking machine with an inkjet printing mechanism having at least one print head for printing flat postal objects, such as letters or postcards, inserted into or passing through the machine, comprised of a guide part (317) arranged so as to project from the print head and relative to its jet opening plane and having correlated therewith a transport device for transporting the postal objects between it and oppositely positioned conveying rollers rotating about axes oriented transverse to the conveying direction, wherein the transport device comprises two drive rollers forming together with the guide part a conveying path, which drive rollers, when viewed in the conveying direction (F), are supported before and behind the print head, and counterpressure rollers arranged opposite thereto are provided, which exert a pressure against the drive roller or the postal object to be transported therebetween, wherein the printing mechanism has at least two print heads (301A, 301B) having a common jet opening plane, in that the print heads (301A, 301B), when viewed onto the jet opening plane, are rectangularly shaped, positioned at an acute angle to the conveying direction (F) of the postal objects and positioned partially staggered relative to one another.

2. Machine according to claim 1, wherein at least one of the print heads (301A, 301B) is movable in the direction deviating from the conveying direction (F) of the postal objects relative to the other print head (301A, 301B).

3. Machine according to claim 1, wherein the adjustable print head (301B) is fastened on a print head support plate (304) adjustable relative to a print head support plate (305) which is stationary and receives the stationary print head (301A) and is arranged perpendicularly to the jet opening plane.

4. Machine according to claim 2, wherein the print head support plates (304, 305) are formed by a clamping device (306, 307) acting in the adjusting direction.

5. Machine according to claim 4, wherein the print head support plates (304, 305) resting against one another with their back sides are formed by angled portions at an end arranged in the adjusting direction, wherein between them a spring (307) is provided on an adjusting screw (306) connecting the portions (306).

6. Machine according to claim 3, wherein the adjustable print head support plate (304) can be secured by a screw (309) penetrating it and rotatably fastened within the stationary print head support plate (305).

* * * * *